US008430404B2

(12) United States Patent
Donald

(10) Patent No.: US 8,430,404 B2
(45) Date of Patent: Apr. 30, 2013

(54) BOARD GAME APPARATUS

(76) Inventor: Shannon Lakeith Donald, Baltimore, MD (US)

( * ) Notice: Subject to any disclaimer, the term of this patent is extended or adjusted under 35 U.S.C. 154(b) by 0 days.

(21) Appl. No.: 13/152,794

(22) Filed: Jun. 3, 2011

(65) Prior Publication Data

US 2012/0306154 A1 Dec. 6, 2012

(51) Int. Cl.
*A63F 3/00* (2006.01)

(52) U.S. Cl.
USPC ..... 273/261; 273/258

(58) Field of Classification Search ..... 273/258, 273/260, 261, 262, 287; D21/334, 340, 348
See application file for complete search history.

(56) References Cited

U.S. PATENT DOCUMENTS

| | | | | | |
|---|---|---|---|---|---|
| 1,119,870 | A * | 12/1914 | Pettit | 273/282.1 |
| 3,024,026 | A * | 3/1962 | Goetz | 273/275 |
| 3,404,890 | A * | 10/1968 | Christy | 273/241 |
| 3,791,649 | A | 2/1974 | Gold | |
| 4,645,209 | A * | 2/1987 | Goulter et al. | 273/271 |
| 5,269,531 | A * | 12/1993 | McNamara | 273/275 |
| 5,312,112 | A * | 5/1994 | Cohen | 273/272 |
| 6,446,969 | B1 | 9/2002 | Denoual | |
| 6,702,287 | B1 * | 3/2004 | Pendexter | 273/261 |
| 2002/0149151 | A1 * | 10/2002 | Denoual | 273/260 |
| 2009/0212498 | A1 | 8/2009 | Schweich | |
| 2010/0072703 | A1 | 3/2010 | Samaniego et al. | |
| 2011/0024983 | A1 * | 2/2011 | Lando | 273/236 |

FOREIGN PATENT DOCUMENTS

| | | | |
|---|---|---|---|
| GB | 2177609 | A | 1/1987 |
| GB | 2227674 | A | 8/1990 |
| JP | 08196687 | A | 8/1996 |

* cited by examiner

*Primary Examiner* — Vishu K. Mendiratta
(74) *Attorney, Agent, or Firm* — The Law Firm of Andrea Hence Evans, LLC

(57) ABSTRACT

The present invention features a game apparatus having a game board having game spaces and game pieces. The apparatus comprises fabulous five game pieces and blank game pieces with indicia on one side identifying the game piece is a traveler. Only a traveler can move in a forwards and backwards direction on the game board in one or two game spaces. The game pieces move in a diagonal motion two diagonal game spaces or a ricochet motion, which is in a curved motion to one game space in the first column and then to a second game space in the second column. The player who cannot move or the player who has no remaining game pieces on the board loses the game.

19 Claims, 6 Drawing Sheets

BOARD GAME APPARATUS

FIELD OF THE INVENTION

The present invention relates generally to a board game, and more particularly to a two-dimensional board game having moveable pieces.

BACKGROUND OF THE INVENTION

Playing games with friends and family is a fun and enjoyable way to spend time together. Just by virtue of playing them, board games can teach important social skills, such as communicating verbally, sharing, waiting, taking turns, and enjoying interaction with others. Board games can foster the ability to focus, and lengthen the player's attention span by encouraging the completion of an exciting, enjoyable game. Board games help to improve memory, build confidence, and enhance educational skills. However, some games require less thought processing and low imagination or skills.

SUMMARY OF THE INVENTION

The present invention provides a board game that is suspenseful, fun and requires developing a winning strategy. Concentration is necessary to play this game successfully.

In an aspect of an embodiment of the present invention, the board game apparatus provides a board game having a two dimensional board with an array of colored circles.

In another aspect of an embodiment of the present invention, the board is divided into two sides, wherein each player has its own designated side.

In a further aspect of an embodiment of the present invention, the board game apparatus has game pieces whereby the first player to capture all of his opponent's pieces or the first player that prevents his opponent from having another move wins the game.

In a further aspect of an embodiment of the present invention, the game pieces have a top and bottom side, wherein one side designates the game piece is in a travel mode.

DETAILED DESCRIPTION OF THE INVENTION

Figure 1:
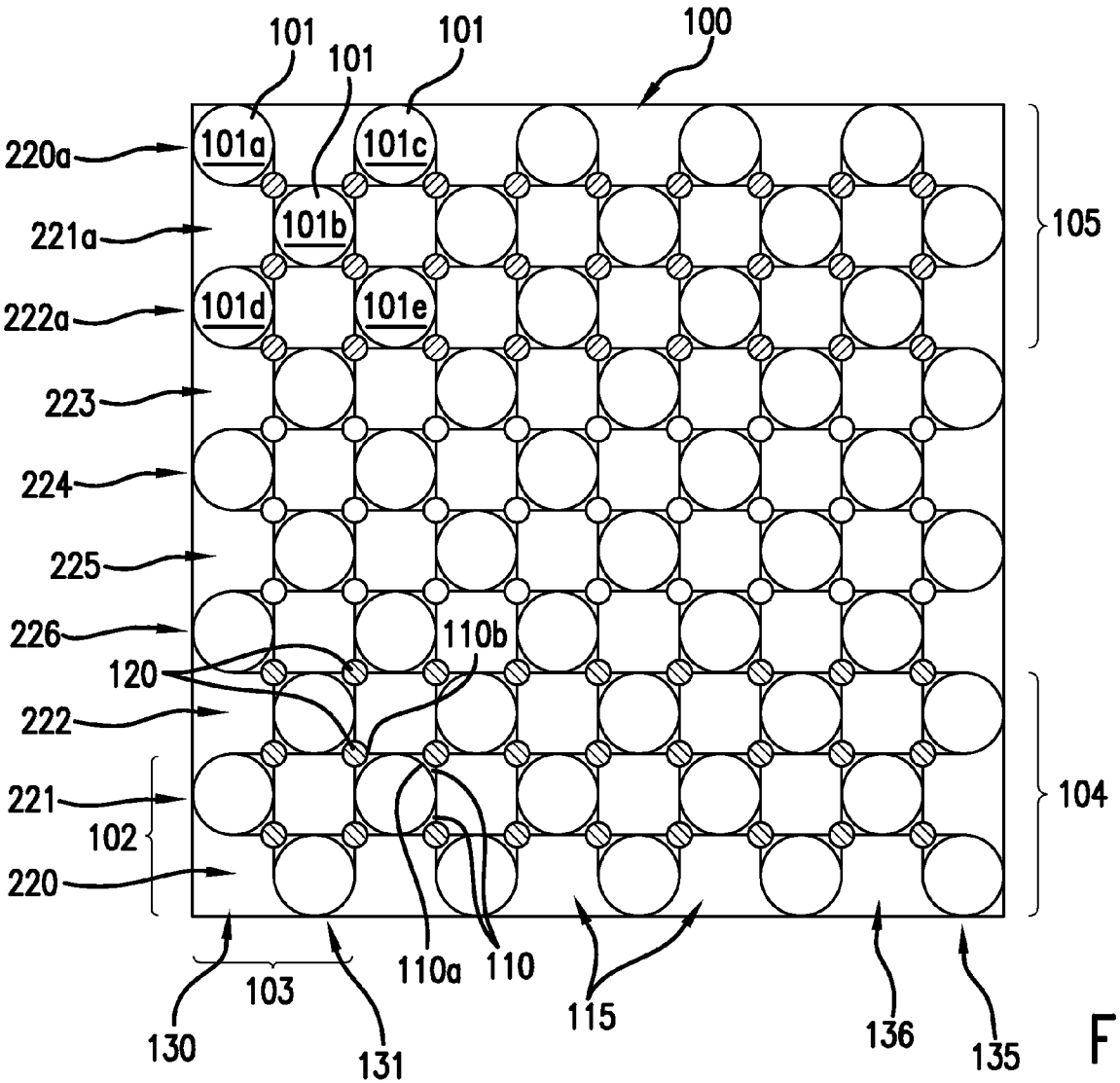
FIG. 1 is a top view of the game board used with the game board apparatus.

FIG. 1 is a top view of the game board 100 used with the game board apparatus 900. The game apparatus comprises a game board 100 having game spaces 101, multiple rows 102, and multiple columns 103. The game board 100 is preferably square with ten rows 102 and ten columns 103 so that the board 100 is a 10×10 board. The game is divided into two sides, a first player side 104 and an opponent or second player side 105. The sides 104, 105 are divided so that at least two players, a player and an opponent can play against each other. The first player side 104 and the opponent side 105 are the territories of a first player and an opponent, respectively.

The game spaces 101 are circular and comprise outside borders 110. The borders 110 feature a bottom side 110*a* that contacts a corner portion of the game space 101 and the bottom side 110*a* has the curved shape of the circular game spaces.

The top side 110*b* of the border 110 forms a circle 120. The circle 120 is a color to identify the game spaces 101 on the player's side 104 or the opponent's side 105. For example, the circles 110*b* on the player's side may be a red color and the circles 110*b* on the opponent's side may be a blue color. Some game spaces 101 feature borders 110 along four corner portions of the circular game space. Some game spaces 101 have one or two borders 110. There is a vacant space 115 to the left or right of every game space 101. The borders 110 and more specifically the circles 120 on the borders overlap with the game spaces 101 such that the circle 120 of one game space is shared with the circle 120 of another game space. The number of borders is determined by the number of corner portions on the circular game space 101 that are diagonal to a different game piece. For example, game space 101*a* has only one diagonal game space 101*b* next to it. Thus, game space 101*a* has one border. However, game space 101*b* is bordered by four diagonal game spaces 101*a*, 101*c*, 101*d* and 101*e*. Thus, game space 101*b* has four borders around each corner portion between the respective diagonal game spaces, as shown in FIG. 1. The game spaces 101 alternate on both the player's and opponent's sides such that between each game space 101 are vacant spaces 115. Game pieces 200 cannot move onto the vacant spaces 115.

There are ten rows 102 and ten columns 103 on the game board 100. The first column 130 is the first of the ten columns 103. It is the first column closest to the edge of the game board. The second column 131 is the column immediately next to the first column 130. It is the second of ten columns 103 on the game board. The last column 135 is the tenth column on the game board 100. The last column 135 is the column closest to the edge on the opposite of the game board 100 from the first column 130. The next-to-last column 136 is the column immediately preceding the last column 135 on the game board 100. The multiple rows 102 has at least a first player side row 220 on the first player side 104 and a first opponent side row 220*a* on the opponent side 105, whereby the first player side row 220 and the first opponent side row 220*a* are the first rows on the player and the opponent sides, respectively.

Figure 2A:
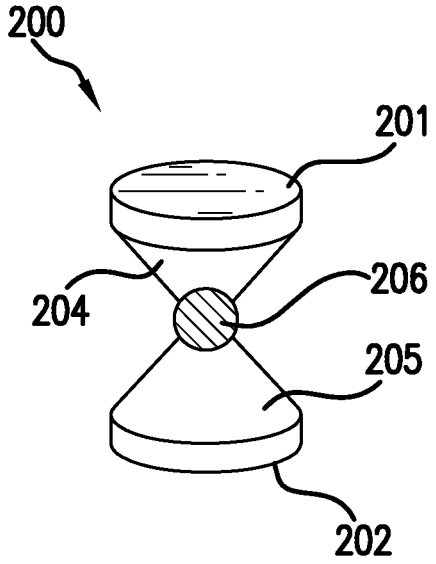
FIG. 2*a* is a perspective view of a game piece used with the game board apparatus.
Figure 2B:
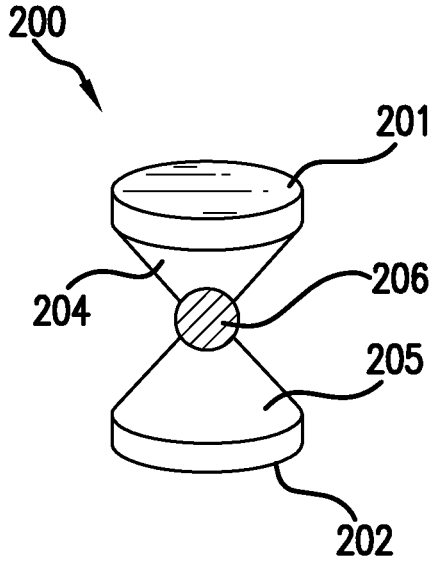
FIG. 2*b* is a perspective view of an alternate game piece used with the game board apparatus.

FIGS. 2*a* and 2*b* are a perspective view of a game piece 200 used with the game board apparatus. The game pieces are symmetrical. The top 201 and bottom 202 of the game piece 200 are round. The circular top 201 and bottom 202 are identical in size to the circle in the circular game spaces 101. However, the tops 201 and bottoms 202 may be smaller than the circular game spaces 101. When the game pieces 200 are placed on their respective game spaces 101, only the borders 110 are shown. The game piece 200 is comprised of two inverted triangles 204 and 205 that connect at the points of the triangles by a ball 206. The game pieces 200 feature colors that match the colors of the sides on the game board 100, such as blue and red. Then, the player and opponent can easily identify which game pieces belong to them and they can also recognize which pieces they are to capture to win the game.

Each player is assigned 15 game pieces 200 to be placed on the first 220, 220*a*, second 221, 221*a* and third rows 222, 222*a* on each side of the game board 100. There are four rows 223, 224, 225, and 226 between third rows 222 and 222*a*. These rows comprise the field on the game board 100. The first player side 104 comprises the first player's fabulous five game pieces 301 and blank game pieces 310 and the opponent player side 105 comprises the opponent's fabulous five game pieces 301 and blank game pieces 310.

Figure 3:
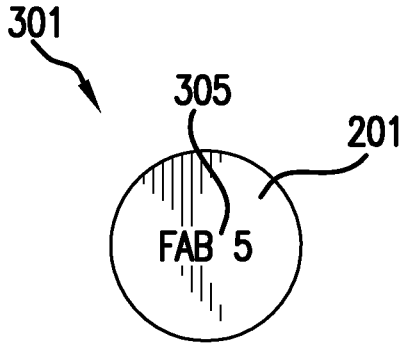
FIG. 3 is a top view of a fabulous five game piece.
Figure 4:
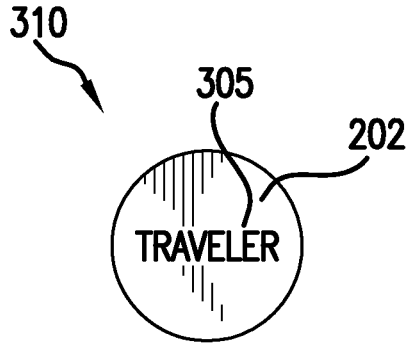
FIG. 4 is a bottom view of a blank game piece or a fabulous five game piece.

Five of the fifteen game pieces 200 assigned to each player are fabulous five game pieces 301. The remaining ten game pieces are blank game pieces 310. The top 201 of the game pieces 200 is the side facing up such that the players can view indicia 305 on the game pieces. FIG. 3 is a top view of a fabulous five game piece 301. The fabulous five game pieces 301 have the indicia, FAB 5 on the top side 201 illustrating the game piece one of the fabulous five game pieces. FIG. 4 is a bottom view of a blank game piece 310 or a fabulous five game piece 301. The top 201 of the blank game piece 310 has no indicia. Instead, the top 201 of the blank game piece may be the same color as the player's side such as red or blue. The bottom 202 of the blank game piece 310 and fabulous five game piece 301 are identical. The indicia 305, TRAVELER is shown on the bottom 202 of both the fabulous five game pieces 301 and the blank game pieces 310. This illustrates that the player is a traveler. Similarly, a color, symbol, design or alternate word may be shown on the bottom sides of the blank game piece 310 or a fabulous five game piece 301 to identify that the player is a traveler.

Figure 5:
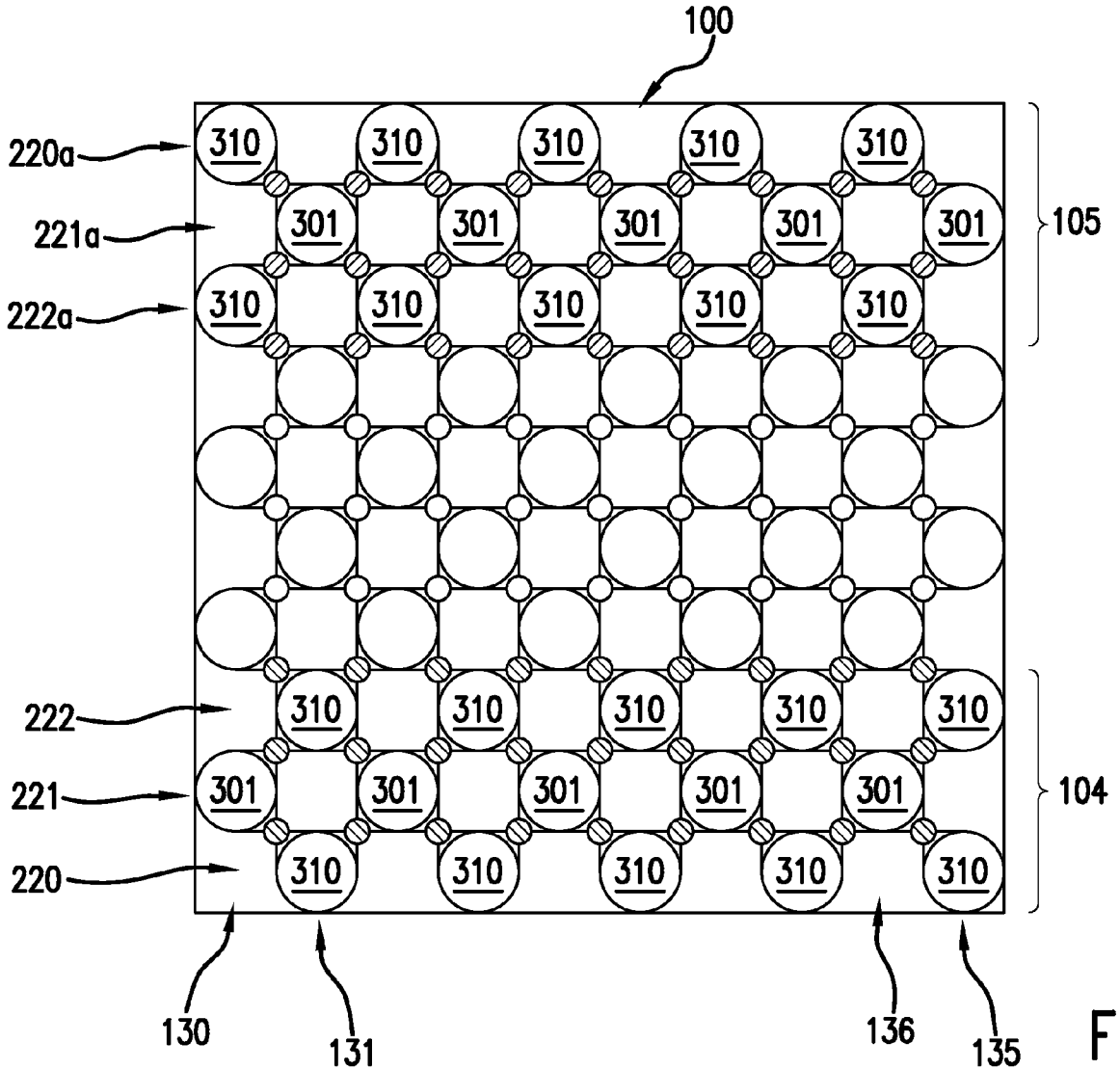
FIG. 5 is a top view of the fabulous five game pieces and the blank game pieces positioned on the game board.

FIG. 5 is a top view of the Fabulous Five game pieces 301 and the blank game pieces 310 positioned on the game board 100 when the game is in a ready state, meaning the game is set up such that it is ready to be played. The fabulous five game pieces 301 are positioned between two rows 220 and 222 of blank game pieces 310 on the game spaces 101 on the first player 104 and second player sides 105, respectively. Game spaces 101 are where the game pieces 301 and 310 are positioned at the start of the game.

Figure 6:
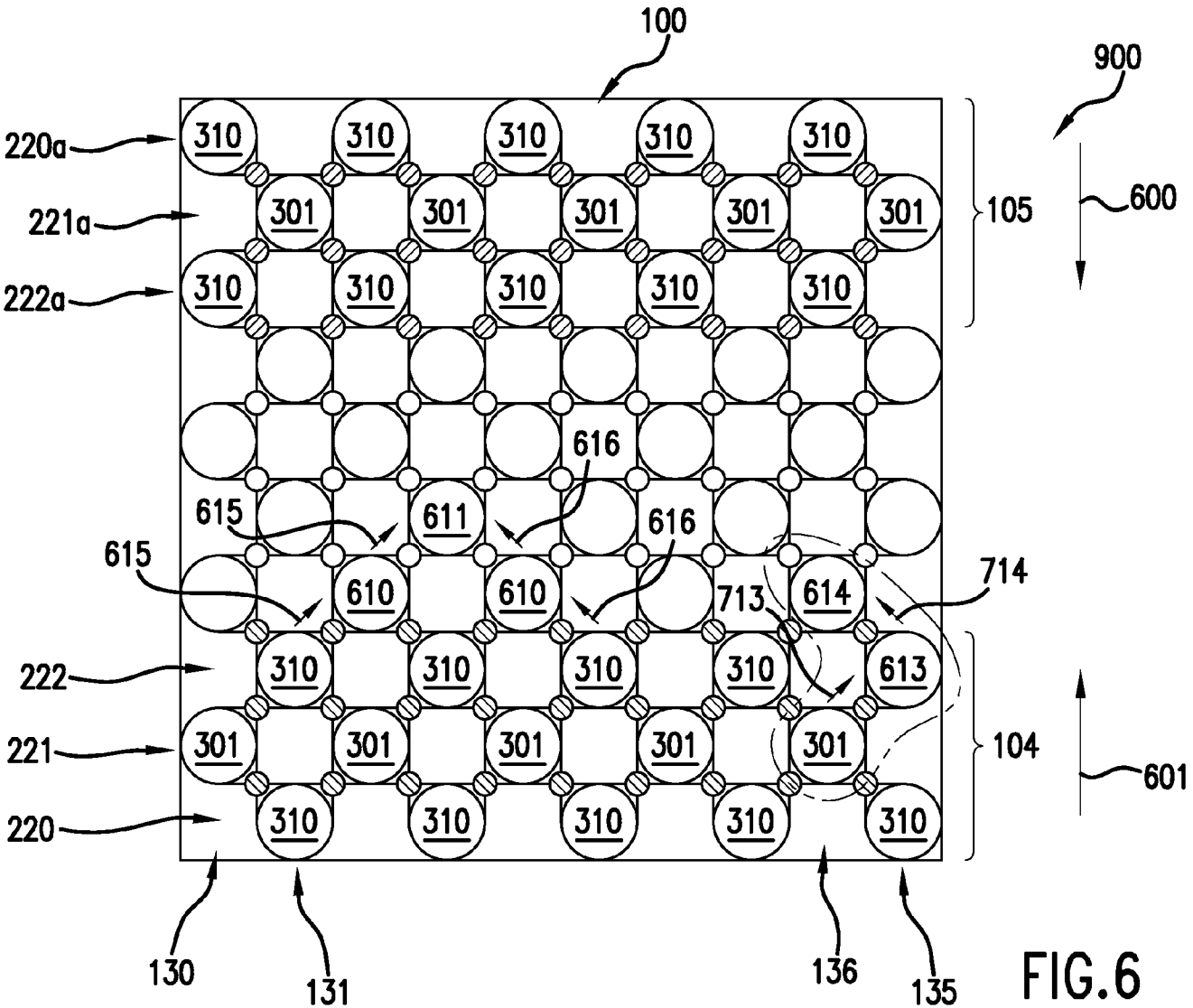
FIG. 6 illustrates the movement of the blank game pieces and fabulous five game pieces on the game board.

FIG. 6 illustrates the movement of the blank game pieces 310 and fabulous five game pieces 301 on the game board 100. Game pieces 200 move in a forward direction, until they become a traveler. The forward direction is the direction towards the opponent's game side. Thus, the first player game pieces 200 on the first player side 104 will move in forward direction shown by the arrow 600 towards the second player's side 105 and the second player game pieces 200 on the second player side 105 will move in a forward direction shown by the arrow 601 towards the first player's side 104. Each game piece 200 moves two game spaces. The fabulous five game pieces 301 and the blank game pieces 310 move a first diagonal game space 610 and a second diagonal game space 611 in a diagonal straight line 615. The diagonal straight line may be in a left diagonal direction 616 or a right diagonal direction 615. If the player's own game piece 200 is on the first diagonal space, the player cannot move. However, if the player's opponent's game piece is on the first diagonal space, the player jumps the opponent's game piece such that the opponent's game piece is removed from the game board and collected by the player. Similarly, the opponent can capture the player's game pieces if they are on the first diagonal game space, when the opponent is moving two diagonal spaces. If a player has the option to move so that the opponent's game piece can be captured or jumped, it is required that the jump and removal of the game piece be made or the player's game piece is removed and given to the opponent and the player loses a turn. Losing a turn means the player is skipped one time so that the opponent can make two moves.

The fabulous five game pieces 301 and the blank game pieces 310 move in a forward direction two diagonal game spaces when the indicia reads FAB 5 or the top side is blank, shown by the color of the game piece.

Figure 7:
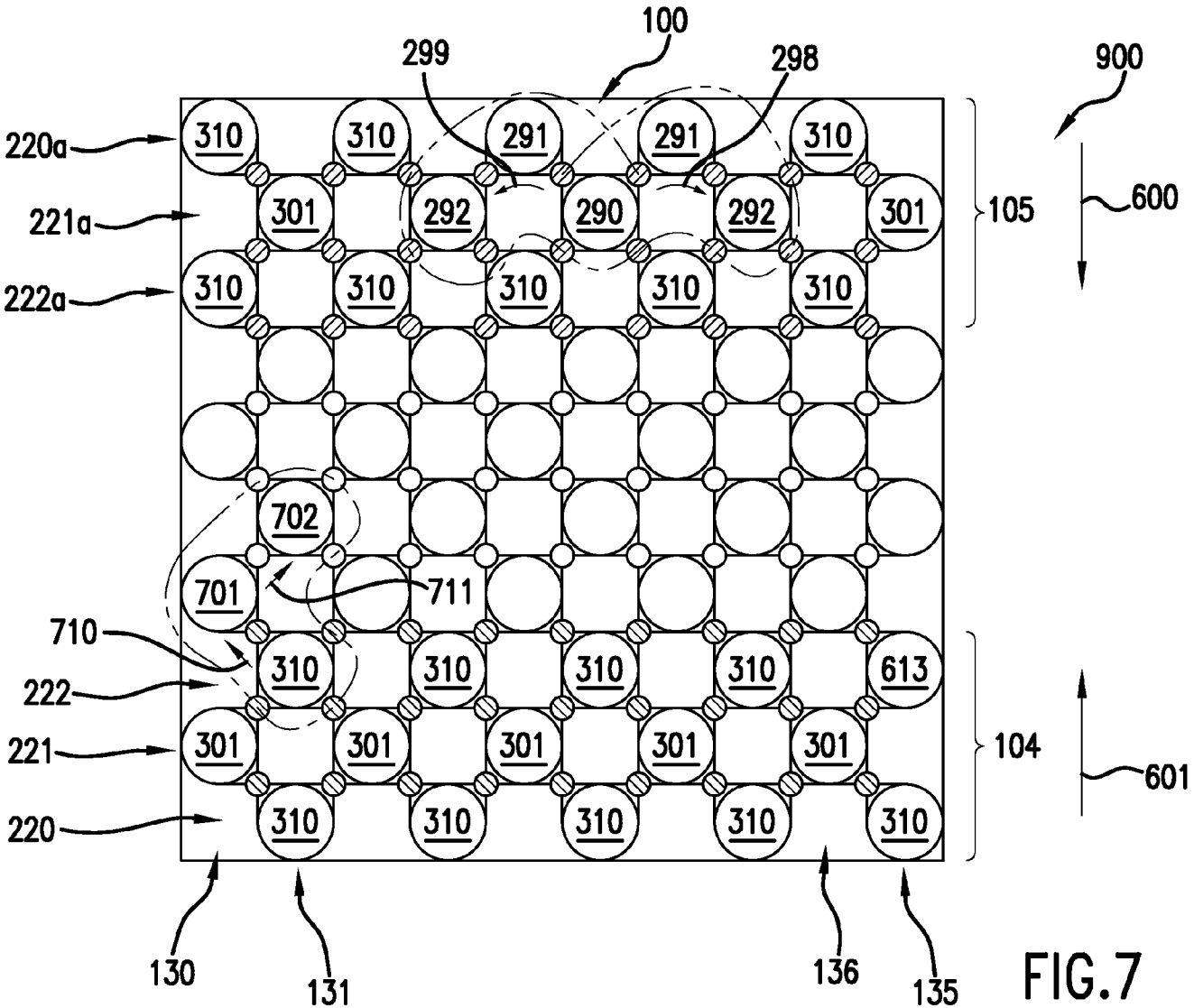
FIG. 7 illustrates the curved movement of the blank game pieces and fabulous five game pieces.

FIG. 7 illustrates the curved movement of the blank game pieces 310 and fabulous five game pieces 301. When a blank game piece 310 or a fabulous five game piece 301 is on a game space in the second column 131, the game piece 310 or 301 moves two game spaces in a curved motion from the second column 131 diagonally 710 one game space 701 to the first column 130 and then diagonally 711 to a different game space 702 in the second column 131. Similarly, when a blank game piece 310 or a fabulous five game piece 301 is on a game space in the next-to-last column 136, the game piece 310 or 301 moves two game spaces in a curved motion from the next to last column 136 diagonally 713 one game space 613 to the last column 135 and then diagonally 714 to a different game space 614 in the next to last column 136, as shown in FIG. 6. The curved motion can also be performed off of the first rows 220, 220*a*. If the game piece is on the second row 221, 221*a*, it can move one diagonal game space 291 in the left curved motion 299 or the right curved motion 298 and then back to a different position 292 on the second row. If the opponent's game piece is in space 291, it can be removed if the player is a TRAVELER. If the player is not a traveler, the player cannot move unless the space 291 is not occupied.

Figure 8:
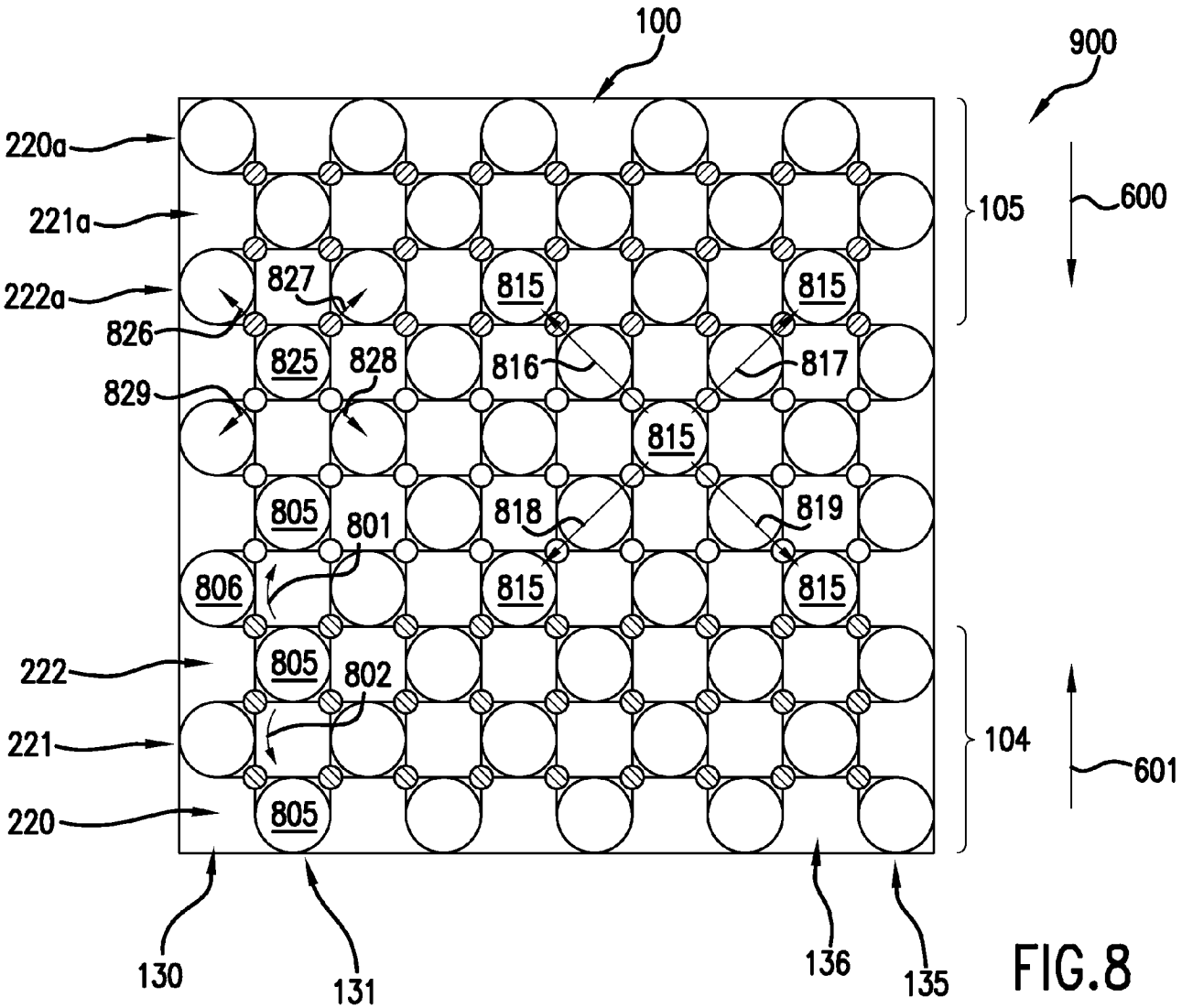
FIG. 8 illustrates the movement of the game pieces when they are travelers on the game board.

When a player's fabulous five game piece 301 reaches the opponent's first row 220*a*, the fabulous five game piece 301 becomes a traveler. The game piece is flipped over so that the TRAVELER indicia 305 on its bottom side 202 is shown. When the fabulous five game piece 301 becomes a traveler, the traveler can move in the diagonal motion or the curved motion discussed above in a forward and backwards direction. The traveler can also move in a forwards or backwards direction 826, 827, 828 and 829 one diagonal game space, as shown in FIG. 8. Backwards direction is opposite the forward direction. For the player, it is movement of the game piece towards the player's first row. For the opponent, it is movement of the game piece towards the opponent's first row. In a backwards direction, game pieces can be jumped and removed if they are in the first of two game spaces when the game piece is moved. Only a traveler can move in a forwards and backwards direction. And only a traveler can jump and remove its opponent's game piece during the curved motion movement if the game piece is in the first of two game spaces when moving in the curved motion. If the game piece is not a traveler, and the opponent's game piece is in the first game space, the game piece cannot move in the curved motion. When the first player's blank game piece 310 reaches the first opponent side row 220*a*, the blank game piece becomes a traveler, wherein the traveler can move in the diagonal motion or the curved motion direction in a forward or backwards direction, as discussed. The blank piece 310 is flipped over such that the TRAVELER indicia 305 is shown to indicate the player is in traveler mode. The blank piece, now a traveler moves the same as the Fabulous five game piece 301 that became a traveler. The fabulous five game piece 301 must become a traveler first before the blank game piece can become a traveler. That is, once a fabulous five game piece becomes a traveler, all of the player's additional game pieces are eligible to become a traveler when they reach the first row. Travelers can move in the curved motion in a forwards 801 and backwards 802 direction as well. For discussion purposes only the player and the player side 104 are discussed. However, the opponents game pieces will move towards the player's side 104 in the same manner discussed.

FIG. 8 illustrates the movement of the game pieces when they are travelers 805, 815, 825 on the game board. The travelers 805,815 825 moves two spaces either diagonally or in a curved motion to jump an opponent's game piece. Otherwise, the travelers 805, 815, 825 move one game space. Traveler 805 can move in a curved motion one game space and jump the blank game piece 806 so that it is captured by the player and then move back to the second column to a different game space. If the traveler is not on the second column or the next to last column, such as traveler 815, the traveler can move diagonal two spaces in a forwards 816, 817 and backwards directions 818, 819. If an opponent's game piece was on the first space, it can be removed and captured by the player. Each player as a traveler removes each other's game pieces if the game piece is on the first diagonal game space when the players move in the diagonal straight line. Game pieces cannot be jumped or removed when the fabulous five and blank game pieces move in the curved motion. Jumps may be made in the curved motion when the game piece to be removed is in a game space in the tenth column or the first column. The player or the opponent that cannot move its game pieces 200 loses the game. Or, the first player to capture all of their opponent's game pieces or all of the fabulous five game pieces wins the game.

The invention has been described in detail with particular reference to certain preferred embodiments thereof, but it will be understood that variations and modifications can be effected within the spirit and scope of the invention.

The invention claimed is:

1. A game apparatus comprising:

a game board having game spaces, multiple rows, and multiple columns, wherein the game board is divided into a first player side and an opponent player side, wherein the multiple columns comprises at least a first column and second column and a next-to-last column and a last column, wherein the game spaces comprise an inner circle tangential to a square border, wherein the corners of the square border form a circular node which forms an outer edge of the game space, wherein the circular node is shared with an alternating space between the game spaces, wherein the alternating space is a square vacant space without an inner circle, blank and fabulous 5 game pieces comprised of frustoconical symmetrical shapes that connect by a spherical connector in the center, wherein the fabulous 5 game pieces are at least five game pieces assigned to the first and opponent player, having indicia which indicates on a top side that they are fabulous 5game pieces, fabulous 5 game pieces positioned between two rows of blank game pieces on the game spaces on the first player and second player sides, respectively;

wherein the fabulous 5 game pieces and the blank game pieces move a first diagonal game space and a second diagonal game space in a diagonal straight line, wherein the fabulous 5 game pieces and the blank game pieces on the second column or the next-to-last column move two games spaces in a curved motion from the second column to the first column and then back to the second column or from the next-to-last column to the last column and then back to the next to last column.

2. The game apparatus of claim 1, wherein the first player side and the opponent side are the territories of a first player and an opponent, respectively.

3. The game apparatus of claim 2, wherein the first player side comprises the first player's fabulous five game pieces and blank game pieces and the opponent player side comprises the opponent's fabulous five game pieces and blank game pieces.

4. The game apparatus of claim 3, wherein the multiple rows comprises at least a first player side row on the first player side and a first opponent side row on the opponent side, whereby the first player side row and the first opponent side row are the first rows on the player and the opponent sides, respectively.

5. The game apparatus of claim 4, wherein when a first side player's fabulous five game piece reaches the first opponent side row, the fabulous five game piece becomes a traveler, wherein the traveler can move in the diagonal motion or the curved motion direction in a forward and backwards direction.

6. The game apparatus of claim 5, wherein the fabulous five game pieces and the blank game pieces move only in the forward direction until they become the traveler.

7. The game apparatus of claim 4, wherein when the first player's blank game piece reaches the first opponent side row, the blank game piece becomes a traveler, wherein the traveler can move in the diagonal motion or the curved motion direction in a forward or backwards direction.

8. The game apparatus of claim 7, wherein the fabulous game pieces features a first side having a first side indicator and a second side indicator, wherein the first side indicator identifies the game piece is a fabulous five game piece and the second side indicator identifies the game piece is the traveler.

9. The game apparatus of claim 8, wherein the blank game pieces features a first side having a first side blank indicator and a second side blank indicator, wherein the first side blank indicator identifies the game piece is a blank game piece and the second side blank indicator identifies the game piece is the traveler.

10. The game apparatus of claim 1, wherein the first player game pieces captures the opponent game pieces, the captured opponent game pieces are removed from the game board.

11. The game apparatus of claim 1, wherein the opponent's game pieces captures the first player's game pieces, the captured first player's game pieces are removed from the game board.

12. A game apparatus for a player and an opponent comprising:

a game board having game spaces, 10 rows, and 10 columns, wherein the game board is divided into a first player side and an opponent player side;

multiple game pieces comprising fabulous five game pieces and blank game pieces that move to a first diagonal game space and a second diagonal game space in a diagonal straight line, wherein the blank and fabulous 5 game pieces are comprised of frustoconical symmetrical shapes that connect by a spherical connector in the center, wherein the game spaces comprise an inner circle tangential to a square border, wherein the corners of the square border form a circular node which forms an outer edge of the game space, wherein the circular node is shared with an alternating space between the game spaces, wherein the alternating space is a square vacant space without an inner circle, wherein the fabulous five game pieces and the blank game pieces on a second column move in a curved motion to a game space in a first column and then to a second game space in the second column; wherein the fabulous five game pieces and the blank game pieces on a ninth column move in a curved motion to a game space in a tenth column and then to a second game space in the ninth column.

13. The game apparatus of claim 12, wherein the fabulous five game pieces and blank game pieces move in a forward direction until a first fabulous five game piece of the fabulous five game pieces moves to the first row becoming a traveler.

14. The game apparatus of claim 13, wherein the traveler moves in a forwards or backwards direction.

15. The game apparatus of claim 14, wherein the blank game pieces move in a forward direction until the blank game pieces move to the first row becoming the traveler.

16. The game apparatus of claim 15, wherein the blank game piece cannot become the traveler until the first fabulous five game piece is the traveler.

17. The game apparatus of claim 15, wherein the player and opponent remove each other's game pieces if the game piece is on the first diagonal game space when the player and opponent move in the diagonal straight line.

18. The game apparatus of claim 17, wherein game pieces cannot be removed when the fabulous five and blank game pieces move in the curved motion unless the game pieces are travelers and the game piece is game space in the tenth column.

19. The game apparatus of claim 12, wherein the player has an equal amount of the game pieces on the first player side as the opponent on the opponent side.

* * * * *